US008726876B2

(12) United States Patent
Kobayashi et al.

(10) Patent No.: US 8,726,876 B2
(45) Date of Patent: May 20, 2014

(54) OIL SEPARATOR FOR INTERNAL COMBUSTION ENGINE

(75) Inventors: Akihiro Kobayashi, Niiza (JP); Atsushi Nonaka, Kawagoe (JP); Masanori Suto, Kawagoe (JP)

(73) Assignee: Mahle Filter Systems Japan Corporation, Tokyo (JP)

( * ) Notice: Subject to any disclaimer, the term of this patent is extended or adjusted under 35 U.S.C. 154(b) by 0 days.

(21) Appl. No.: 13/534,626

(22) Filed: Jun. 27, 2012

(65) Prior Publication Data

US 2013/0125865 A1 May 23, 2013

(30) Foreign Application Priority Data

Nov. 21, 2011 (JP) ..... 2011-253428

(51) Int. Cl.
*F01M 13/04* (2006.01)

(52) U.S. Cl.
USPC ..... 123/196 CP; 123/573; 123/196 M

(58) Field of Classification Search
USPC ..... 123/573, 574, 572, 434, 90.38, 196 R, 123/196 A, 196 CP, 196 M
See application file for complete search history.

(56) References Cited

U.S. PATENT DOCUMENTS

| | | | | |
|---|---|---|---|---|
| 4,569,323 | A * | 2/1986 | Okumura | 123/572 |
| 4,627,406 | A * | 12/1986 | Namiki et al. | 123/573 |
| 4,723,529 | A * | 2/1988 | Yokoi et al. | 123/573 |
| 6,725,849 | B2 * | 4/2004 | Stegmaier et al. | 123/572 |
| 6,860,915 | B2 * | 3/2005 | Stegmaier et al. | 55/337 |
| 7,011,690 | B2 * | 3/2006 | Altvater et al. | 55/312 |
| 7,055,509 | B2 * | 6/2006 | Hara | 123/572 |
| 7,117,858 | B2 | 10/2006 | Nonaka et al. | |
| 7,631,639 | B2 * | 12/2009 | Yonebayashi et al. | 123/572 |
| 8,061,336 | B2 * | 11/2011 | Takeuchi | 123/572 |
| 2004/0103889 | A1 * | 6/2004 | Akiyama et al. | 123/572 |
| 2005/0092267 | A1 | 5/2005 | Nonaka et al. | |

FOREIGN PATENT DOCUMENTS

| | | | |
|---|---|---|---|
| JP | 09-096209 | A | 4/1997 |
| JP | 2000-45749 | A | 2/2000 |
| JP | 2005-120855 | A | 5/2005 |
| JP | 2009-121281 | A | 6/2009 |
| JP | 2010-84582 | A | 4/2010 |
| JP | 2010-84628 | A | 4/2010 |

* cited by examiner

*Primary Examiner* — Noah Kamen
*Assistant Examiner* — Long T Tran
(74) *Attorney, Agent, or Firm* — Foley & Lardner LLP

(57) ABSTRACT

An oil separator disposed inside a cylinder head cover of an internal combustion engine. The oil separator includes a body section defining an elongate separator chamber and having a blowby gas inlet and a blowby gas outlet. A partition wall is disposed to divide the separator chamber into an inlet chamber at side of the blowby gas inlet and an outlet chamber at side of the blowby gas outlet. The partition wall is formed with a plurality of passage holes each of which is triangular in cross-section. A collision plate is disposed inside the outlet chamber and located opposite to the passage holes of the partition wall. A slit-like opening is defined by a lower section of the collision plate and communicated with a drain section for discharging oil separated from blowby gas into a valve operating chamber.

7 Claims, 7 Drawing Sheets

OIL SEPARATOR FOR INTERNAL COMBUSTION ENGINE

BACKGROUND OF THE INVENTION

This invention relates to improvements in an oil separator disposed inside a cylinder head cover of an internal combustion engine to separate oil mist from blowby gas discharged outside through the cylinder head cover.

For example, in an automotive internal combustion engine, blowby gas containing unburned components and leaked from a combustion chamber to a crankcase is introduced through an engine intake system into the combustion chamber to burn the unburned components together with fresh air taken in from outside, as well known. Blowby gas passing through the inside of the crankcase contains oil mist, and therefore an oil separator is disposed at a part of the cylinder head cover as disclosed in Japanese Patent Provisional Publication Nos. 2005-120855 and 2009-121281 in order to prevent oil mist from being carried to the engine intake system. After oil mist is separated and removed by this oil separator, blowby gas is taken out from the inside of the cylinder head cover. In general, two blowby gas passages are connected to the cylinder head cover, in which fresh air is introduced through one of them under a normal operating condition, while blowby gas flows through both of them under a high engine load operating condition. Accordingly, two oil separators are respectively provided in the two blowby gas passages.

The oil separator disclosed in the Patent Provisional Publications is a so-called inertial collision-type oil separator, in which a partition wall formed with many passage holes is disposed inside an oil separator chamber, and a collision plate is disposed adjacent to this partition wall in such a manner as to be opposite to the passage holes. The flow velocity of blowby gas containing oil mist becomes high when blowby gas passes through the passage holes of the partition wall, so that blowby gas strikes against the collision plate at a high speed after getting out of the flow passages so that oil mist adheres onto the collision plate and recovered. The collision plate is formed at its bottom section with a slit-like opening through which oil grown as large droplets upon being separated by the collision plate is flown along the bottom surface of the oil separator to a downstream side and then dropped into a valve operating chamber through the bottom end discharge outlet of a drain pipe disposed at the bottom wall of the oil separator.

Here, in general, the passage holes formed in the above partition wall is circular in cross-section as disclosed in Japanese Patent Provisional Publication No. 2005-120855. In this regard, Japanese Patent Provisional Publication No. 9-96209 discloses an oil separator using passage holes which are rectangular or hexagonal in cross-section though the oil separator is different in basic configuration from that of the above two Japanese Patent Provisional Publications.

SUMMARY OF THE INVENTION

In order to further improve a trapping performance (efficiency) for oil mist in the inertia collision-type oil separator, it is required to increase the flow velocity of blowby gas ejected from the passage holes by decreasing the cross-sectional area of the passage holes.

However, if the cross-sectional area of each passage hole is thus decreased, a pressure loss between the upstream side and downstream sides of the partition wall unavoidably rises according to decrease in passage hole cross-sectional area. As a result, this pressure loss lowers the pressure within the oil separator chamber at the downstream side of the partition wall, so that oil tends to reversely flow from the side of the valve operating chamber through the drain pipe to the side of the oil separator chamber, which is problematic.

In other words, it is difficult to make the trapping performance of oil mist compatible with the pressure loss at sufficient levels, the trapping performance and the pressure loss being in the relationship of trade-off in configuration of conventional oil separators.

In order to overcome difficulties encountered in conventional oil separators, the present invention has been made. The present invention resides in an oil separator for an internal combustion engine, disposed inside a cylinder head cover to separate oil mist from blowby gas to be discharged out of the cylinder head cover. The oil separator comprises a section defining an elongate separator chamber and having first and second ends. The section includes a blowby gas inlet located at side of the first end, and a blowby gas outlet located at side of the second end. A partition wall is disposed to divide the separator chamber into an inlet chamber at side of the blowby gas inlet and an outlet chamber at side of the blowby gas outlet. The partition wall is formed with a plurality of passage holes each of which pierces the partition wall. A collision plate is disposed inside the outlet chamber and located opposite to the passage holes of the partition wall. The collision plate has a lower section located at a lower part of the outlet chamber, the lower section of the collision plate defining a slit-like opening located at the lower part of the outlet chamber and extends throughout at least a part of width of the collision plate. Additionally, a drain section is provided to discharge oil separated from blowby gas from the lower part of the outlet chamber into a valve operating chamber. In the above oil separator, each of the passage holes of the collision plate is triangular in cross-section.

Specifically, with an oil separator provided with a partition wall formed with general passage holes circular in cross-section, under the actions of contraction generated at the inlet opening portion of each passage hole and a boundary layer at the wall surface of each passage hole due to viscosity of fluid, flow of blowby gas concentrates to the cross-sectional center of the passage hole so that blowby gas flows through a cross-sectional central part of the passage hole, thereby narrowing a substantial passage area. This raises a pressure loss across the partition wall at a remarkable high level.

In contrast, according to the present invention or the oil separator provided with the partition wall formed with the passage holes triangular in cross-section, an area where the flow rate of blowby gas is high can become broader in each passage hole than that in each passage hole circular in cross-section. In other words, a uniform flow velocity distribution of blowby gas can be obtained in each passage hole as compared with the conventional oil separator provided with the partition wall formed with passage holes circular in cross-section. This increases the substantial passage area of each passage hole, thereby lowering a pressure loss across the partition wall. Additionally, according to experiments conducted by the present inventors, as discussed after, the oil separator of the present invention exhibited such results that the pressure loss is lowered while improving the trapping efficiency of oil mist. Although the mechanism for so improving the trapping efficient is strictly unclear, it is assumed that blowby gas containing oil mist flows through each passage hole without being excessively locally concentrated and with a relatively uniform flow velocity distribution to strike against a collision plate, and therefore oil mist can be totally effectively separated.

Preferably, in the present invention, each of the passage holes is in the shape of isosceles triangle in cross-section, in which the cross-sectional isosceles triangle having a base parallel with a lower edge of the collision plate. Blowby gas passed through the plurality of the passage holes in the partition wall strikes against the collision plate and flows through the opening formed at the lower section of the collision plate toward the downstream side, and therefore blowby gas is directed downward as a whole. As a result, the flow velocity distribution in each passage hole spreads along the base of the isosceles triangle which base extends laterally, so that the distribution becomes more uniform. It is not preferable that the isosceles triangle has an excessively small vertical angle in order to prevent the passage hole from becoming slit-shaped. Typically, the triangle may be equilateral triangle; however, it will be understood that the equilateral triangle may not be accurate equilateral triangle.

Preferably, in the present invention, a plurality of the passage holes are aligned along a direction in which the base of the isosceles triangle extends, in which the respective cross-sectional triangles of the two passage holes adjacent to each other are vertically reversed to each other. With this configuration, the opposite sides of the respective triangles of the two adjacent passage holes are parallel with each other, which is advantageous from the viewpoint of securing a strength of the partition wall. Accordingly, the passage holes can be effectively arranged in a limited region of the partition wall.

Preferably, in the present invention, each of the passage holes has a length of not less than two times an equivalent diameter of the passage hole. In other words, each passage hole is sufficiently elongate so that flow of blowby gas, particularly oil mist, can certainly strike against the collision plate without excessively spreading.

Thus, according to the present invention, by forming the passage holes triangular in cross-section, the trapping performance of oil mist and the pressure loss across the oil separator can be compatible at high levels.

The other objects and features of this invention will become understood from the following description with reference to the accompanying drawings.

BRIEF DESCRIPTION OF THE DRAWINGS

In the drawings, like reference numerals designate like parts and elements throughout all figures, in which.

DETAILED DESCRIPTION OF THE INVENTION

Figure 1:
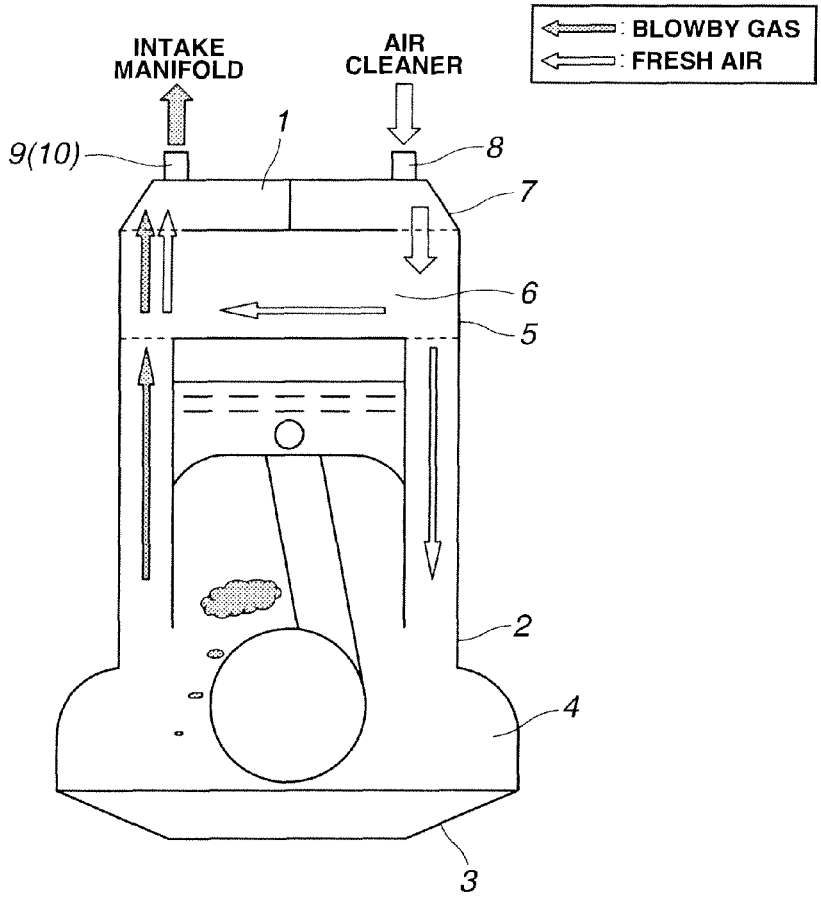
FIG. 1 is a schematic sectional view of an internal combustion engine provided with an embodiment of an oil separator according to the present invention.

Referring now to FIG. 1 of the drawings, an embodiment of an oil separator according to the present invention is illustrated by the reference numeral 1. The oil separator 1 is incorporated in an internal combustion engine including a cylinder block 2 and an oil pan 3 which define a crankcase 4. A cylinder head 5 is secured on the cylinder block 2 to form a valve operating chamber 6 thereinside. The valve operating chamber 6 is in communication with the crankcase 4. A cylinder head cover 7 is secured on the cylinder head 5 to form part of a blowby gas treatment system. The cylinder head cover 7 has a fresh air inflow (introduction) opening 8 connected to a part (for example, an air cleaner) of an intake system of the engine which part is located at the upstream side of a throttle valve, though not shown. Additionally, the cylinder head cover 7 has a blowby gas outflow (take-out) opening 9. A known PCV (Positive Crankcase Ventilation) valve 10 is disposed in the blowby gas outflow opening 9 to control the flow rate of blowby gas according to a pressure difference between the upstream and downstream sides of the valve 10.

In such a configuration, fresh air is introduced through the fresh air inflow opening 8 according to a pressure difference between the upstream and downstream sides of the throttle valve so as to ventilate the inside of the crankcase 4 and the inside of the valve operating chamber 6. Blowby gas inside the crankcase 4 and the valve operating chamber 6 is introduced together with this fresh air through the PCV valve 10 in the blowby gas outflow opening 9 into the downstream side of the throttle valve.

Additionally, the oil separator 1 is disposed inside the cylinder head cover 7 provided with the blowby gas outflow opening 9 in order to remove oil mist mixed in this blowby gas.

It is to be noted that dark arrows in FIG. 1 indicate flow of blowby gas during low and medium engine load operating conditions; however, a part of blowby gas is also discharged through the fresh air inflow passage 8 into the intake system during a high load engine operating condition in which the throttle valve is around a fully opened position. Accordingly, it is general that an oil separator similar to that 1 may be disposed also at the side of the fresh air inflow opening 8. It will be understood that the oil separator 1 according to the present invention may be used as that at the side of the blowby gas outflow opening 9 or as that at the side of the fresh air inflow opening 8.

Figure 2:
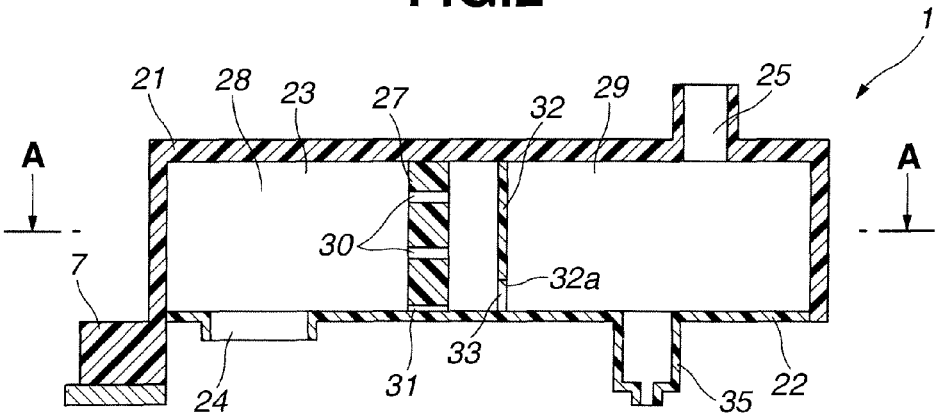
FIG. 2 is a vertical sectional view of the oil separator of FIG. 1.
Figure 3:
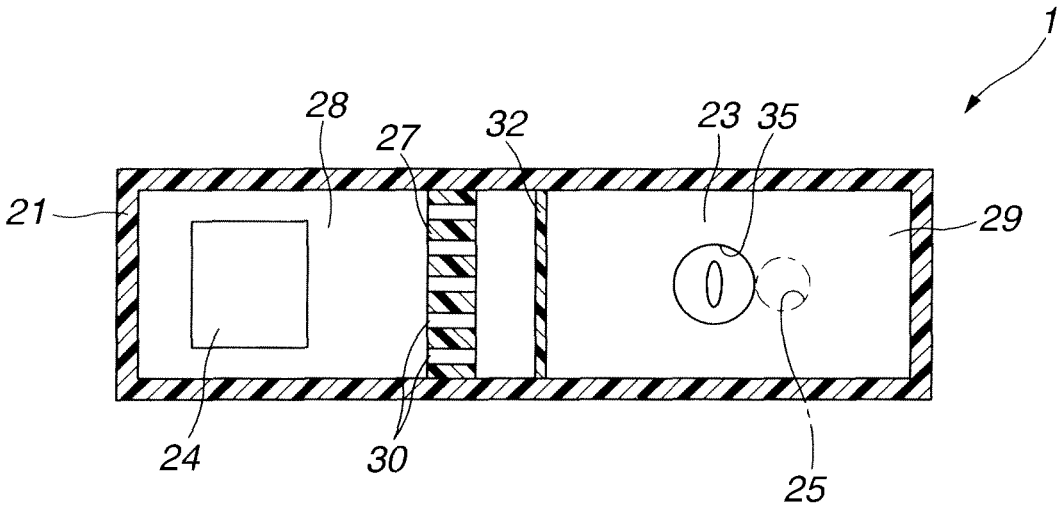
FIG. 3 is a transverse sectional view taken in the direction of arrows substantially along the line A-A of FIG. 2.

FIGS. 2 and 3 show the oil separator 1 itself incorporated in the cylinder head cover 7 as discussed above. The oil separator 1 includes a cover-shaped housing section 21 which is elongate and opened at its bottom to form a bottom opening, so that an elongate passage-like space is defined inside the housing section 21. The housing section 21 is formed integral with the cylinder head cover 7 in such a manner that a part of the oil separator forms part of the cylinder head cover 7 which is formed of plastic or synthetic resin. In this instance, the housing section 21 is formed integral with a ceiling section of the cylinder head cover 7. Additionally, an elongate separator cover 22 formed of plastic or synthetic resin is installed to the bottom section of the housing section 21 to close the bottom opening of the housing section 21. It will be understood that the oil separator of the present invention is not limited to this embodiment and therefore may take such a configuration that the housing section (21) is formed independent and separate from the cylinder head cover 7.

The oil separator 1 in this instance elongates in a direction perpendicular to the row of engine cylinders (or in a width direction of the engine). An elongate separator chamber 23 having a rectangular cross-section perpendicular to the longitudinal direction thereof is defined between the housing section 21 and the separator cover 22. A blowby gas inlet 24 is formed in the separator cover 22 and located at one end section of the separator chamber 23 in the longitudinal direction whereas a blowby gas outlet 25 is formed in the ceiling portion of the housing section 21 and located at the other end section of the separator chamber 23 in the longitudinal direction. Accordingly, blowby gas flows inside the separator chamber 23 basically linearly along the longitudinal direction of the separator chamber 23.

The blowby gas inlet 24 is formed in the separator cover 22 and has an opening which is rectangular in cross-section. In other words, in this embodiment, the blowby gas inlet 24 is opened or connected to the bottom part of the separator chamber 23, so that the separator chamber 23 is in communication with the valve operating chamber 6 through this blowby gas inlet 24. The blowby gas outlet 25 is located at the ceiling portion of the housing section 21 and formed piecing the ceiling portion of the housing section 21 in this embodiment. As discussed above, in case that the oil separator 1 is disposed on the side of the blowby gas outflow opening 9, the blowby gas outlet 25 serves as the blowby gas outflow opening 9, in which the PCV valve (not shown) is installed in the blowby gas outlet 25. It is to be noted that the blowby gas outlet 25 may be located at an end part (whose relatively upper position) of the elongate separator chamber 23.

A plate-shaped partition wall 27 is disposed perpendicular to the longitudinal direction of the separator chamber 23 or the separator cover 22, and located generally at an intermediate part of the separator chamber 23 in the longitudinal direction. This partition wall 27 divides the separator chamber 23 into an inlet chamber 28 at the side of the blowby gas inlet 24 and an outlet chamber 29 at the side of the blowby gas outlet 25. In this instance, this partition wall 27 is formed integral with the separator cover 22 and extends upward to reach the ceiling portion of the housing section 21. In contrast, the partition wall 27 may be formed integral with the housing section 21 or the cylinder head cover 7. The partition wall 27 is formed with a plurality of passage holes 30 which serve as orifices for increasing the flow velocity of blowby gas, as discussed in detail after. The partition wall 27 is formed with two cutout portions 31 which are located at the opposite corners of the lower end section thereof, in order to allow oil droplets formed in the inlet chamber 28 to flow to the side of the outlet chamber 29.

A collision plate 32 is disposed in the outlet chamber 29 and located adjacent to and parallel with the partition wall 27 in the outlet chamber 29. The collision plate 32 is opposite to or faces the passage holes 30 in the partition wall 27 at a suitable distance from the partition wall 27 so as to separate oil mist from blowby gas flowing at a high speed through the passage holes 30. In this instance as shown, the collision plate 32 is formed integral with the separator cover 22 similarly to the partition wall 27, and extends upward to reach the ceiling portion of the housing section 21. In contrast, the collision plate 32 may be formed integral with the housing section 21. It will be understood that the surface of the collision plate 32 may be formed uneven, for example, by forming a plurality of vertically extending grooves at the surface of the collision plate 32. A lower section of the collision plate 32 defines a slit-like opening 33 whose lower end is defined by the separator cover 22. The upper end of the opening 33 is defined by a lower edge of the collision plate 32 which extends parallel with the upper surface of the separator cover 22. In this instance as shown, the collision plate 32 is formed integral with the separator cover 22 in such a manner as to stand from the upper surface of the separator cover 22, and therefore the opening 32 is formed to be opened like a window at a lower central section of the collision plate 32 in the width direction so that lower opposite end sections of the collision plate 32 in the width direction remain to support the main body of the collision plate 32. For example, in case of forming the collision plate 32 integral with the housing section 21, the opening 33 may be formed extending throughout the whole width of the collision plate 32. Oil separated at the surface of the collision plate 32 flows downward and flows through the opening 33, and then flows along the upper surface of the separator cover 22 defining the separator chamber 23 so as to be carried to the downstream side.

A drain pipe 35 is formed integral with the separator cover 22 and located to be opened to the bottom part of the outlet chamber 29, serving as a drain section for discharging collected oil to the side of the valve operating chamber 6. The drain pipe extends downward into the valve operating chamber 6 and has a small discharge opening through which oil is discharged.

With the above-configured oil separator 1, the passage of blowby gas flowing from the blowby gas inlet 24 through the separator chamber 23 to the blowby gas outlet 25 is narrowed in passage area by the passage holes 30 piercing through the partition wall 27 so as to form a high speed gas flow of blowby gas, and then strikes against the surface of the collision plate 32. As a result, oil mist contained in blowby gas is separated and adhered to the surface of the collision plate 32. The thus trapped oil mist gradually grows to large liquid droplets and drop from the lower edge 32*a* of the collision plate 32 to the upper surface of the separator cover 22 defining the bottom part of the separator chamber 23, followed by flowing along the upper surface of the separator cover 22 to the downstream side. Finally, liquid oil drops from the drain pipe 35 into the valve operating chamber 6. Since the liquid oil is collected inside the drain pipe 35 to a certain level of the drain pile 35, blowby gas can be prevented from its reverse flow through the discharge opening at the lower end of the drain pipe 35 (i.e., inflow of blowby gas from the valve operating chamber 6 in FIG. 1 to the outlet chamber 29).

Here, when blowby gas flows through the passage holes 30 of the partition wall 27, the passage holes 30 serving as flow resistance develop a pressure loss. As this pressure loss is larger, the pressure difference between the inlet chamber 28 and the outlet chamber 29 or the pressure difference between the valve operating chamber 6 and the outlet chamber 29 becomes larger, so that the reverse flow of blowby gas tends to be caused through the drain pipe 35. When such reverse flow of blowby gas is caused, oil inside the drain pipe 35 will be scattered into the outlet chamber 29 and carried to the blowby gas outflow opening 9.

Figure 4:
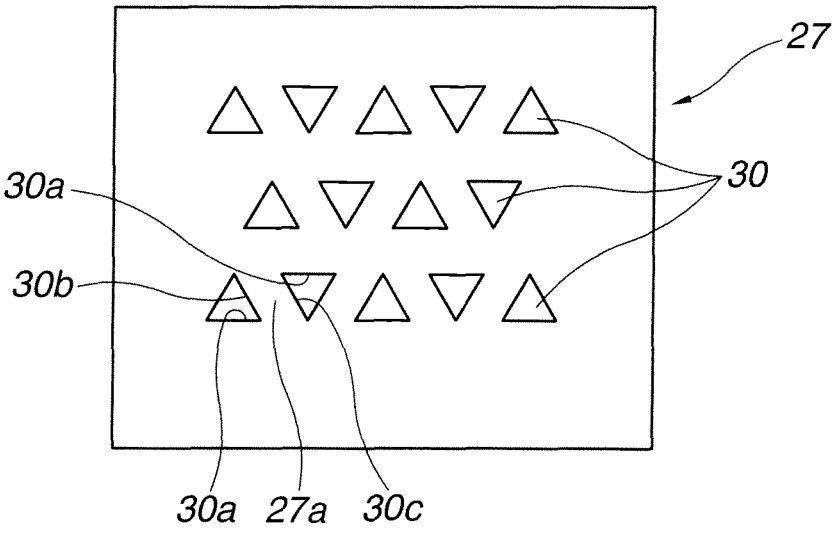
FIG. 4 is a front elevation of a partition wall formed with passage holes, in the oil separator of FIGS. 2 and 3.

FIG. 4 shows a configuration of the passage holes 30 of the partition wall 27 in the above-discussed embodiment. As shown, in this embodiment, the partition wall 27 is rectangular and elongate in the lateral direction so as to have a lateral dimension larger than a vertical dimension. The partition wall 27 is formed with 14 passage holes 30 in total, in which the passage holes 30 form three rows which are respectively at upper, intermediate and lower stages (three stages). Specifically, the passage holes 30 are aligned in each row or at each stage. Each passage hole 30 is equilateral-triangular in cross-section perpendicular to the thickness direction of the partition wall 27 and formed piercing the partition wall 27. The 14 passage holes have the same dimensions and therefore have the same cross-sectional area. Five passage holes 30 are aligned in the row at the upper stage, four passage holes 30 are aligned in the row at the intermediate stage, and five passage holes 30 are aligned in the row at the lower stage, in which the passage holes 30 are aligned at equal intervals, and two passage holes 30 located adjacent to each other in each row are configured such that the respective cross-sectional triangles of the two passage holes 30 are located vertically reversed to each other. For example, the cross-sectional triangle of the first passage hole 30 at the right end in the lower stage row has a base 30*a* parallel with the lower edge of the partition wall 27 (or parallel with the lower edge 32*a* of the collision plate 32). Additionally, a vertex (forming a vertical angle of the cross-sectional triangle and opposite to the base) of the cross-sectional triangle is located at the top. The cross-sectional triangle of the second passage hole 30 adjacent to the above first passage hole 30 has a base 30*a* parallel with the lower edge of the partition wall 27; however, the base is located at the top while the acute-angled part of the cross-sectional triangle is located at the bottom. The cross-sectional triangle of the first passage hole 30 is referred to as "right triangle" while the cross-sectional triangle of the second passage hole 30 is referred to as "reversed triangle" for convenience, so that each of three right triangles and each of two reversed triangles are alternately located in the lower stage row. Similarly in the upper stage row, each of three right triangles and each of two reversed triangles are alternately located. Similarly in the intermediate stage row, each of two right triangles and each of two reversed triangles are alternately located. It will be understood that, in each stage row, all the cross-sectional triangles lie within a range defined by upper and lower straight lines which are parallel with each other, in which the upper straight line passes through the vertex of each right triangle and the base of the reversed triangle whereas the lower straight line passes through the base of each right triangle and the vertex of each reversed triangle. As shown in FIG. 4, each of the five triangles in the lower stage row and each of the five triangles in the upper stage row are respectively located laterally at the corresponding positions to each other. In other words, each of the five cross-sectional triangles in the lower stage row and each of the five cross-sectional triangles in the upper stage row lie on the same straight line which vertically extends. In contrast, the position of each of the four cross-sectional triangles in the intermediate stage row is located laterally offset from the position of each of the triangles in the lower and upper stage rows, so that each triangle in the intermediate stage row is laterally located such that the center of each cross-sectional triangle in the intermediate stage row lies between the centers of the adjacent cross-sectional triangles in the lower and upper state rows.

As discussed above, by alternately locating the right triangle and the reversed triangle, the width or area of a portion 27*a* (referred to as a foot portion, for convenience) remaining between the adjacent two cross-sectional triangles (or passage holes 30) is secured to be constant and wide, which is advantages from the viewpoint of obtaining a sufficient strength of the partition wall 27. In other words, the inclined side 30*b* of one cross-sectional triangle and the inclined side 30*c* of the other cross-sectional triangle of the adjacent two cross-sectional triangles are parallel with each other, and therefore no narrow foot portion (27*a*) having a low strength is locally formed. Accordingly, many passage holes 30 having the rectangular cross-section can be formed within a limited area of the partition wall 27 without lowering the strength of the partition wall 27.

In this embodiment, the passage hole 30 has an equivalent diameter (or diameter of a circle having the same area) of 3 mm in cross-section perpendicular to the thickness direction of the partition wall 27, and a passage length (or thickness of the partition wall 27) of 10 mm. It will be understood that the dimensions of the passage hole 30 are not limited to these, the passage hole 30 may have the equivalent diameter of about 1 to 5 mm. If the equivalent diameter of the triangular passage hole 30 is smaller than 1 mm, it is substantially difficult to machine or form the passage hole 30. If the equivalent diameter is larger than 5 mm, the passage hole 30 cannot sufficiently serve as an orifice so that a sufficiently high flow velocity of blowby gas cannot be obtained thereby lowering the trapping performance of oil mist. The passage length of the passage hole 30 is preferably not less than two times the equivalent diameter in order to allow oil mist to flow straight with a sufficient inertia. The total number of the passage holes 30 in the partition wall 27 is generally about 3 to 20 though it is different according to displacement of the internal combustion engine, dimensions of the oil separator 1, and/or the like.

It is to be noted that the above passage hole 30 triangular in cross-section (referred to as "triangular passage hole") is low in pressure loss and high in the trapping efficiency of oil mist as compared with general passage holes circular in cross-section (referred to as "circular passage hole").

Figure 5:
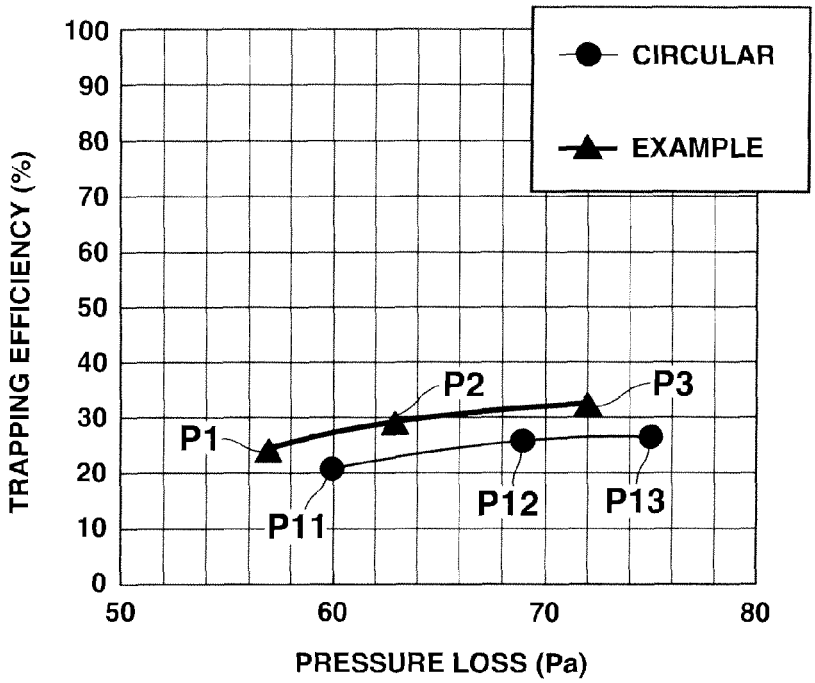
FIG. 5 is a graph showing comparison in characteristics (a trapping efficiency of oil mist and a pressure loss across the oil separator) of the oil separator according to Example (the present invention) including the partion wall formed with passage holes triangular in cross-section and an oil separator according to Comparative Example 1 including a partition wall formed with passage holes circular in cross-section.
Figure 7:
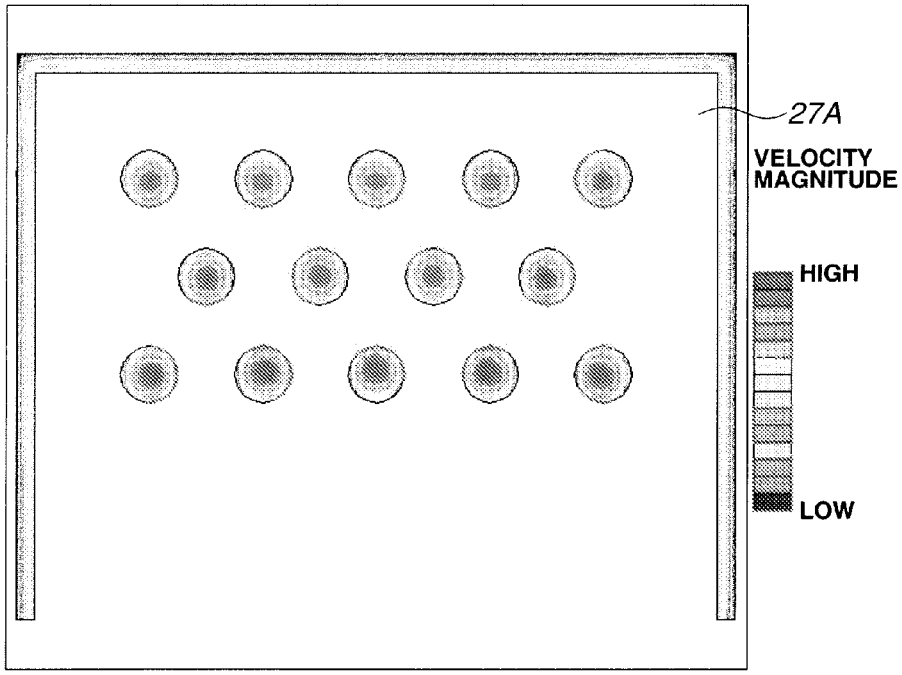
FIG. 7 is an explanative view showing a gas flow velocity distribution in the partition wall of the oil separator of Comparative Example 1.

FIG. 5 is a graph showing results of measurements of trapping efficiency of oil mist and pressure loss between the upstream and downstream sides of the oil separator 1 having the configuration as shown in FIGS. 2 and 3, upon allowing gas containing a certain amount of oil mist to flow at a certain flow velocity through the oil separator 1. Here, comparison in characteristics was made between Example (the above-discussed embodiment) and Comparative Example 1 (an oil separator including a partition wall 27A as shown in FIG. 7) which is similar to Example with the exception that the passage hole (30) was circular in cross-section perpendicular to the thickness direction of the partition wall and had a diameter of 3 mm so as to have the same area as that of the passage hole 30 of the embodiment, in which the pressure loss was on the abscissa while the trapping efficiency of oil mist was on the ordinate. More specifically, plotting in the graph of FIG. 5 was made by changing gas flow rate at three stages or high, medium and low stages, in which points P1 and P11 indicate the characteristics at a low flow rate, points P2 and P12 indicated the characteristics at a medium flow rate, and points P3 and P13 indicates the characteristics at a high flow rate.

In general, as the gas flow rate increases, the flow rate of gas passing through the passage hole 30 becomes high. Therefore, as the gas flow rate increases, the trapping efficiency of oil mist increases while the pressure loss simultaneously increases. However, as shown in the graph of FIG. 5, in case that the comparison in the characteristics was made at the same flow rate, the following results were obtained: The points P1, P2 and P3 of Example (having the triangular passage holes 30) are high in trapping efficiency of oil mist and low in pressure loss as compared with Comparative Example 1 (having the circular passage holes). Additionally, it will be apparent that Example (having the triangular passage holes 30) was high in trapping efficiency as compared with Comparative Example 1 (having the circular passage holes) under the same pressure loss, from the linear characteristics of Example given by connecting the three points P1, P2 and P3 and the linear characteristics of Comparative Example given by connecting the three points P11, P12 and P13.

Specifically, with general circular passage holes, flow of gas concentrates to the cross-sectional center of the passage hole under the action of contraction formed around the inlet of the passage hole and under the action of boundary layer at the wall surface of the passage hole due to viscosity of fluid, and therefore blowby gas substantially flows through the vicinity of the center axis of the circular passage hole thereby narrowing the substantial cross-sectional area of the passage hole thus making a pressure loss remarkable.

In contrast, the following is assumed in case of the oil separator using the triangular passage holes: A region where flow velocity is high is widened in each passage hole as compared with the case of the oil separator using the circular passage holes. In other words, in the case of the oil separator using the triangular passage holes, a more uniform flow velocity distribution can be obtained in each passage hole than the case of the oil separator using the circular passage holes, thereby increasing the substantial passage hole area in each passage hole thus to lower the pressure loss. Additionally, blowby gas containing oil mist can strike against the collision plate through the triangular passage hole in a relatively uniform flow velocity distribution without being excessively locally concentrated. Hence, oil mist can be effectively separated as a whole through the triangular passage hole.

Figure 6:
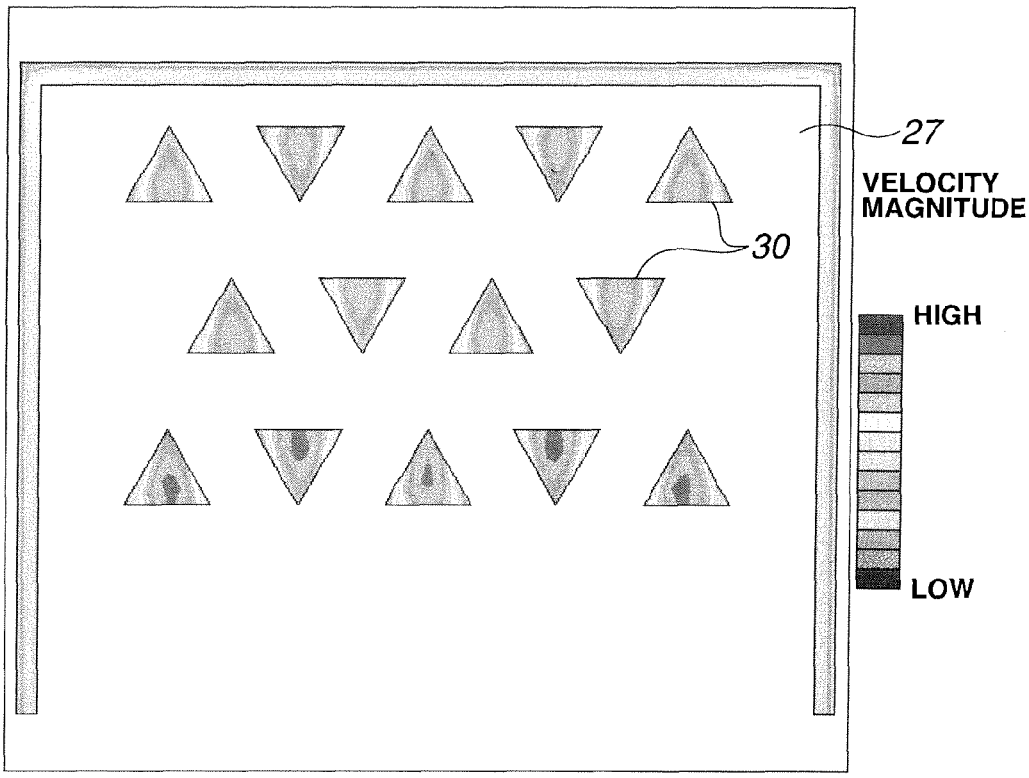
FIG. 6 is an explanative view showing a gas flow velocity distribution in the partition wall of the oil separator according to Example.
Figure 8:
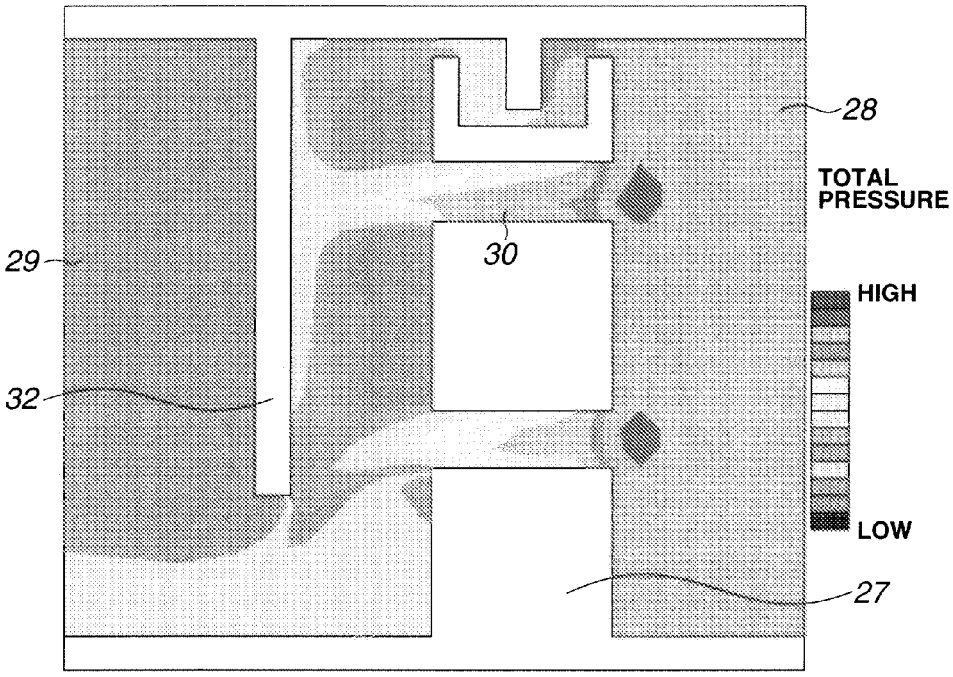
FIG. 8 is an explanative view of a pressure distribution in the essential part of the oil separator according to Example.
Figure 9:
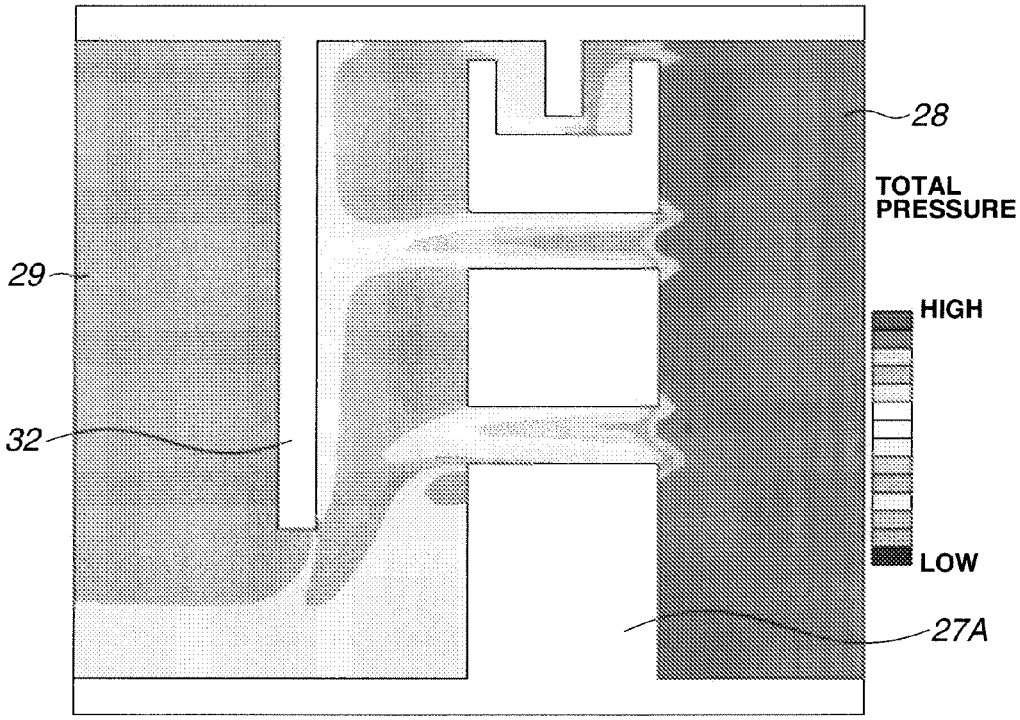
FIG. 9 is an explanative view of a pressure distribution in the essential part of the oil separator according to Comparative Example 1.

FIGS. 6 and 7 respectively show a gas flow velocity distribution of Example using the partition wall 27 formed with the triangular passage holes 30 and a gas flow velocity distribution of Comparative Example 1 using the partition wall 27A formed with the circular passage holes having the same areas as those of the passage holes 30 of Example, obtained by a CAE (Computer Aided Engineering) analysis. FIGS. 8 and 9 respectively show a pressure distribution in a region including the inlet chamber 28, the outlet chamber 29 and the passage hole 30 for communicating the chambers 28, 29 in Example using the circular passage holes 30 and a pressure distribution in a region including the inlet chamber (28), the outlet chamber (29) and the passage hole (30) for communicating the chambers (28, 29) in Comparative Example 1 using the circular passage holes, obtained by the CAE analysis. In FIGS. 8 and 9, gas flows from the right side to the left side. Additionally, Example and Comparative Example are configured such that the pressures at the downstream side of the outlet chamber 29 (29) are set to be equal to each other in Example and Comparative Example 1 as shown in FIGS. 8 and 9. Accordingly, the pressures at the side of the inlet chamber 28 (28) are different from each other under a difference in pressure loss in Example and Comparative Example 1. The total gas flow rates in the oil separators of Example and Comparative Example 1 in FIGS. 8 and 9 are equal to each other.

As shown in FIG. 7, in the circular passage hole in Comparative Example 1, flow of gas concentrates to the cross-sectional center of the circular passage hole so that flow velocity becomes locally high only around the cross-sectional center of the passage hole. In other words, the substantial sectional area of the passage hole is decreased. As a result, as shown in FIG. 9, the pressure at the side of the inlet chamber 28 becomes high relative to a certain pressure at the side of the outlet chamber 29, thus increasing the pressure loss.

In contrast, in the triangular passage hole 30 in Example, as shown in FIG. 6, a region where the flow velocity is high spreads along the base (parallel with the lower edge of the partition wall 27 and other than the two sides) of the triangle of the triangular hole 30 so that a high flow velocity can be obtained throughout a wide region, thus increasing the substantial sectional area of the passage hole. As a result, as shown in FIG. 8, the pressure at the inlet chamber 28 becomes low relative to the certain pressure at the side of the outlet chamber 29.

It is to be noted that the above-discussed effects can be obtained only in case of using the triangular passage holes 30 and therefore cannot be obtained even in cases of using passage holes having other complicated shapes in cross-section.

Figure 10:
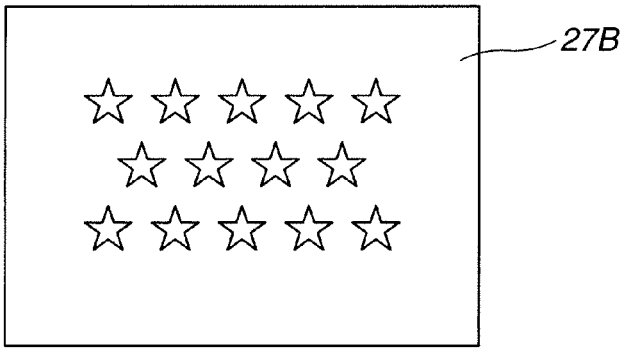
FIG. 10 is a front elevation of a partition wall of an oil separator according to Comparative Example 2 including a partition wall formed with passage holes star-shaped in cross-section.
Figure 11:
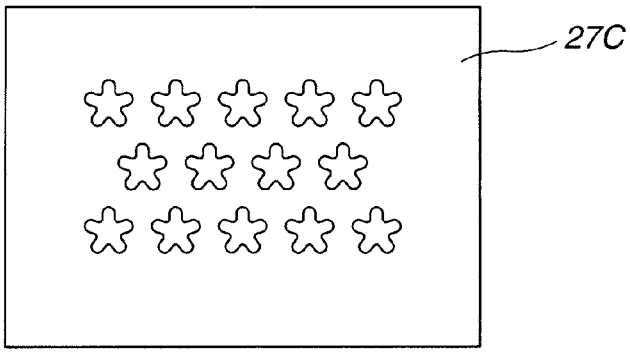
FIG. 11 is a front elevation of a partition wall of an oil separator according to Comparative Example 3 including a partition wall formed with passage holes starfish-shaped in cross-section.
Figure 12:
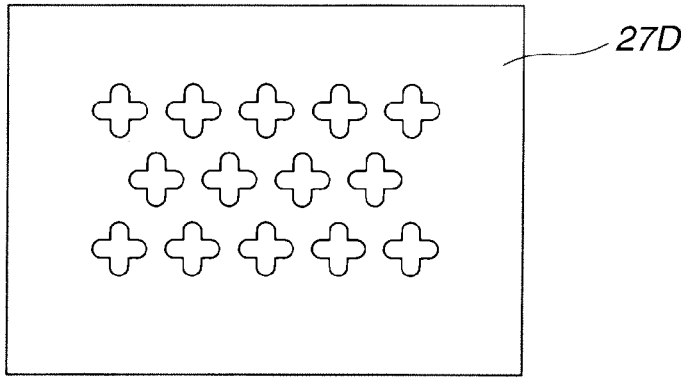
FIG. 12 is a front elevation of a partition wall of an oil separator according to Comparative Example 4 including a partition wall formed with passage holes cross-shaped in cross-section.

FIGS. 10 to 12 illustrate respectively partition walls 27B, 27C, 27D of oil separators according to Comparative Examples 2, 3 and 4, formed with passage holes having complicated shapes, for the comparison purpose with the partition wall 27 of Example having the triangular passage holes. FIG. 10 shows the partition wall 27B (Comparative Example 2) formed with passage holes each of which is star-shaped in cross-section perpendicular to the thickness direction of the partition wall (referred to as "star-shaped passage hole"). FIG. 11 shows the partition wall 27C (Comparative Example 3) formed with passage holes each of which is starfish-shaped in cross-section perpendicular to the thickness direction of the partition wall (referred to as a starfish-shaped passage hole). As seen, the five tip end portions and the inner peripheral portion of each starfish-shaped passage hole is rounded with an arc (in cross-section) whose radius is relatively large. FIG. 12 shows the partition wall 27D (Comparative Example 4) formed with passage holes each of which is cross-shaped in cross-section perpendicular to the thickness direction of the partition wall (referred to as "cross-shaped passage hole"). As seen, the four tip end portions of the cross-shaped passage hole are rounded with an arc (in cross-section) whose radius is relatively large. Each of the partition walls of Comparative Examples 2, 3 and 4 has the same number of the passage holes as that of the passage holes of the partition wall of Example and the same equivalent diameter of each passage hole as that of the partition wall of the Example.

Figure 13:
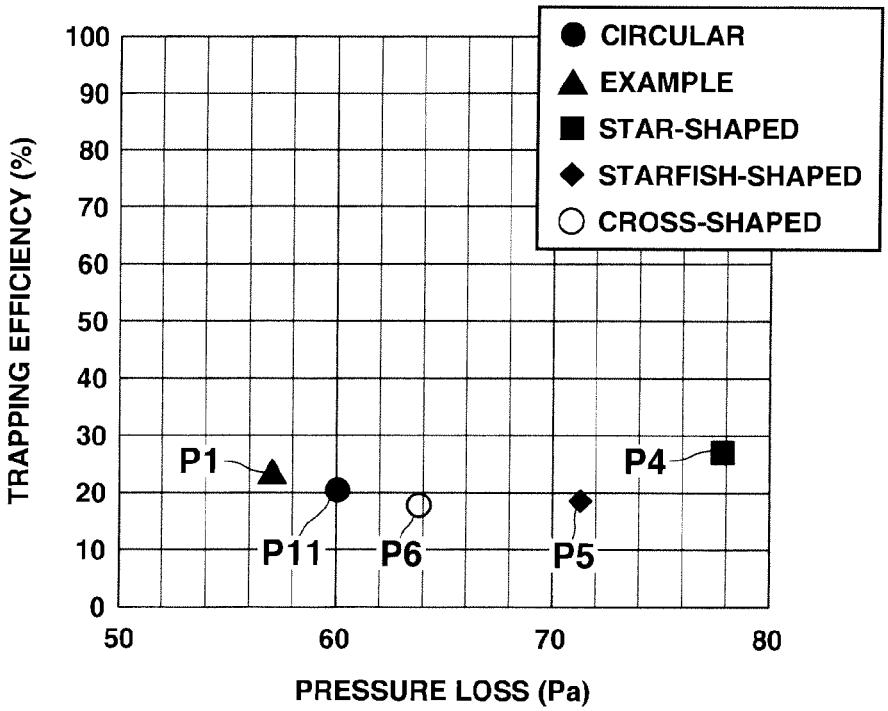
FIG. 13 is a graph showing comparison in characteristics (the trapping efficiency of oil mist and the pressure loss across the oil separator) of the oil separator according to Example with the oil separators according to Comparative Examples 1, 2, 3 and 4.

By using the thus configured partition walls 27B, 27C, 27D, measurements of the trapping efficiency of oil mist and the pressure loss between the upstream and downstream sides of the oil separator 1 were carried out to obtain results shown in FIG. 13, upon allowing gas containing a certain amount of oil mist to flow at a certain flow velocity through the oil separator 1. In FIG. 13, the point P1 (the characteristics of the oil separator using the triangular passage holes) and the point P11 (the characteristics of the oil separator using the circular passage holes) are plotted together, in which the characteristics of each of Comparative Examples 2, 3 and 4 was obtained at the same gas flow rate (the low flow rate of the three stage flow rates in FIG. 5) as that for P1 and P11. In FIG. 13, a point P4 indicates the characteristics of the oil separator using the star-shaped passage holes; a point P5 indicates the characteristics of the oil separator using the starfish-shaped passage holes; and a point P6 indicates the characteristics of the oil separator using the cross-shaped passage holes.

As will be apparent from FIG. 13, in cases of using the starfish-shaped passage holes (indicated by the point P5) and the cross-shaped passage holes (indicated by the point P6), the trapping efficiency is low and the pressure loss is high as compared with the characteristics (the point P1) of the oil separator using the triangular passage holes in Example and even as compared with the characteristics of the oil separator using the general circular passage holes (the point P11). In case of using the star-shaped passage holes (indicated by the point P4), the trapping efficiency is high as compared with the characteristics (the point P1) of the oil separator using the triangular passage holes in Example and the characteristics of the oil separator using the general circular passage holes (the point P11); however, the pressure loss is remarkably high as compared with the characteristics of the triangular passage holes and characteristics of the general circular passage holes. Thus, by using the triangular passage holes in Example, the trapping efficiency and the pressure loss in the relationship of trade-off can be compatible at high levels.

Meanwhile, in case of an oil separator using passage holes rectangular in cross-section or passage holes hexagonal in cross-section as disclosed in Japanese Patent Provisional Publication No. 9-96209, blowby gas flow concentrates in the vicinity of the cross-sectional center of each passage hole similarly in case of using the circular passage holes, thereby exhibiting the characteristics similar to that of the oil separator using the circular passage holes.

Figure 14:
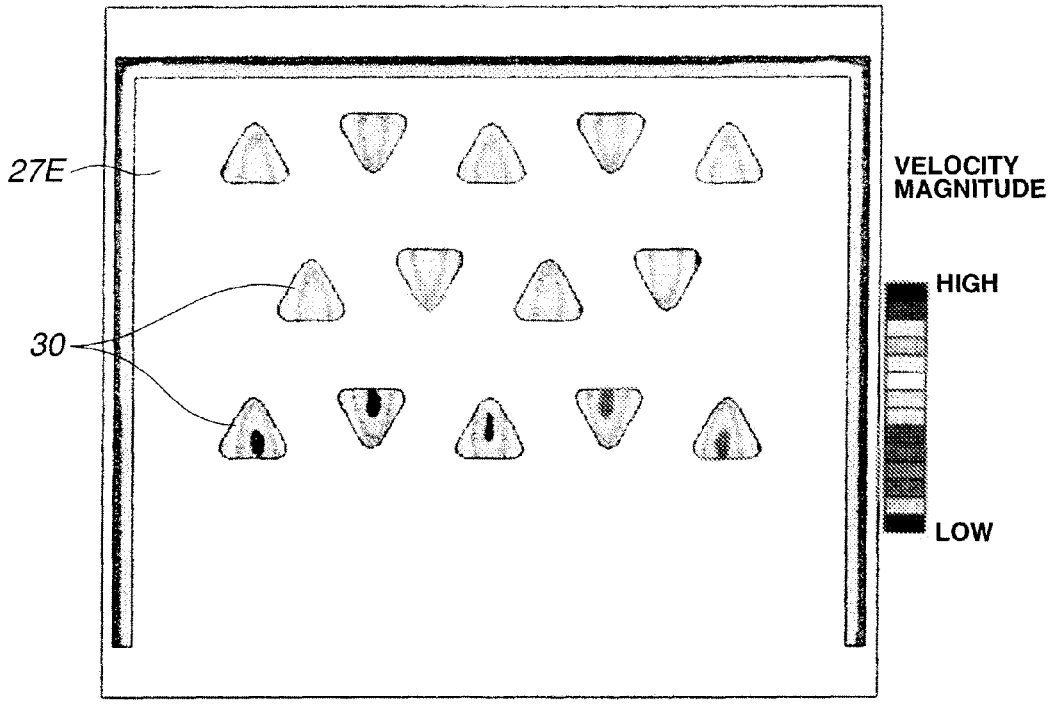
FIG. 14 is an explanative view showing a gas flow velocity distribution in a partition wall of an oil separator, formed with passage holes triangular in cross-section, in which the three tip end portions of each triangular passage hole are rounded.

It is to be noted that the same performance as that of the oil separator using the triangular passage holes in Example can be obtained even if the three tip end portions (corresponding to the three vertical angles of the triangle) of each triangular passage hole are rounded with an arc (in cross-section) whose radium is 0.5 mm as shown in FIG. 14 represented as an example. FIG. 14 shows a gas flow velocity distribution obtained by the CAE analysis similarly to FIG. 6, in a partition wall 27E of an oil separator. As seen in FIG. 14, the similar effects to those by the oil separating using the triangular passage holes can be obtained even in case of the oil separator using the triangular passage holes whose tip end portions are not sharply pointed, so that high flow velocities can be obtained throughout a wide region of each triangular passage hole whose tip end portions are rounded. Though not shown, upon conducting experiments to measure the trapping efficiency and the pressure loss, the substantially same results as those in FIG. 5 could be obtained. Thus, whether the tip end portions of the triangular passage hole are angular or rounded does not substantially affect the trapping efficiency and the pressure loss.

The triangular passage holes whose tip end portions are rounded advantageous from the viewpoint of manufacturing technique for forming the triangular passage holes in the partition wall. Specifically, in case of producing the partition wall formed with the triangular passage holes by die-forming of a molten material or by secondary machining, it is generally not easy to accurately form the three tip end portions (having an acute angle in cross-section) of the triangular passage hole. Accordingly, by employing the triangular passage holes formed by slightly rounding the three tip end portions of the triangular passage holes as shown in FIG. 14, the triangular passage holes can be easily formed by die-forming of molten material or by machining.

Although the invention has been described above by reference to a certain embodiment and Example of the invention, the invention is not limited to the embodiment and Example described above. Modifications and variations of the embodiment and Example described above will occur to those skilled in the art, in light of the above teachings. For example, while the triangle of the triangular passage hole 30 has been shown and described as being the equilateral-triangle, it may be isosceles triangle whose base is parallel with the lower edge 32*a* of the collision plate 32, providing the same effects as apparent from the gas flow velocity distribution in FIG. 6. Even in case that the base of the triangle of the triangular passage hole is not parallel or inclines to the lower edge 32*a* of the collision plate 32, the flow velocity distribution spreads along either side of the triangle, and therefore the pressure loss and the trapping efficiency are improved as compared with the case of the oil separator using the circular passage holes. Additionally, while the partition wall 27 and the collision plate 32 are shown and described as being formed integral with the separator cover 22 formed of plastic so as to serve just as a part of the separator cover 22 in the above embodiment, the present invention is not limited to this, so that one or both of them may be formed integral with the cylinder head cover 7, or may be formed independent from the separator cover or the cylinder head cover to be assembled in position.

While the housing section 21 has been shown as taking the shape of complete rectangular parallelepiped in FIGS. 2 and 3, it is practically general that it takes the shape of slightly deformed rectangular parallelepiped, according to the outer shape of the cylinder head cover 7 and/or the like.

The entire contents of Japanese Patent Applications P2011-253428 (filed Nov. 21, 2011) are incorporated herein by reference.

What is claimed is:

1. An oil separator for an internal combustion engine, disposed inside a cylinder head cover to separate oil mist from blowby gas to be discharged out of the cylinder head cover, the oil separator comprising:

a section defining an elongate separator chamber and having first and second ends, the section including a blowby gas inlet located at a side of the first end, and a blowby gas outlet located at a side of the second end;

a partition wall disposed to divide the separator chamber into an inlet chamber at a side of the blowby gas inlet and an outlet chamber at a side of the blowby gas outlet, the partition wall being formed with a plurality of passage holes each piercing the partition wall;

a collision plate disposed inside the outlet chamber and located opposite to the plurality of passage holes of the partition wall, the collision plate having a lower section located at a lower part of the outlet chamber, the lower section of the collision plate defining a slit-like opening that is located at the lower part of the outlet chamber and extends throughout at least a part of a width of the collision plate;

a drain section configured to discharge oil separated from blowby gas from the lower part of the outlet chamber into a valve operating chamber, wherein each of the plurality of passage holes of the partition wall is triangular in cross-section, wherein each of the passage holes is shaped as an isosceles triangle in cross-section, the cross-sectional isosceles triangle having a base parallel with a lower edge of the collision plate, wherein a plurality of passage holes are aligned along a direction in which the base extends, in which the respective cross-sectional triangles of two passage holes adjacent to each other are vertically reversed to each other.

2. An oil separator for an internal combustion engine, disposed inside a cylinder head cover to separate oil mist from blowby gas to be discharged out of the cylinder head cover the oil separator comprising:

a section defining an elongate separator chamber and having first and second ends, the section including a blowby gas inlet located at a side of the first end, and a blowby gas outlet located at a side of the second end;

a partition wall disposed to divide the separator chamber into an inlet chamber at a side of the blowby gas inlet and an outlet chamber at a side of the blowby gas outlet, the partition wall being formed with a plurality of passage holes each piercing the partition wall;

a collision plate disposed inside the outlet chamber and located opposite to the plurality of passage holes of the partition wall the collision plate having a lower section located at a lower part of the outlet chamber, the lower section of the collision plate defining a slit-like opening that is located at the lower part of the outlet chamber and extends throughout at least a part of a width of the collision plate;

a drain section configured to discharge oil separated from blowby gas from the lower part of the outlet chamber into a valve operating chamber, wherein each of the plurality of passage holes of the partition wall is triangular in cross-section, wherein three tip end portions, corresponding respectively to the three vertical angles of the cross-sectional triangle, of each triangular passage hole are rounded.

3. An oil separator for an internal combustion engine, disposed inside a cylinder head cover to separate oil mist from blowby gas to be discharged out of the cylinder head cover, the oil separator comprising:

a section defining an elongate separator chamber and having first and second ends, the section including a blowby gas inlet located at a side of the first end, and a blowby gas outlet located at a side of the second end;

a partition wall disposed to divide the separator chamber into an inlet chamber at a side of the blowby gas inlet and an outlet chamber at a side of the blowby gas outlet, the partition wall being formed with a plurality of passage holes each piercing the partition wall;

a collision plate disposed inside the outlet chamber and located opposite to the plurality of passage holes of the partition wall, the collision plate having a lower section located at a lower part of the outlet chamber, the lower section of the collision plate defining a slit-like opening that is located at the lower part of the outlet chamber and extends throughout at least a part of a width of the collision plate;

a drain section configured to discharge oil separated from blowby gas from the lower part of the outlet chamber into a valve operating chamber, wherein each of the plurality of passage holes of the partition wall is triangular in cross-section.

4. An oil separator as claimed in claim 3, wherein each of the passage holes is shaped as an isosceles triangle in cross-section, the cross-sectional isosceles triangle having a base parallel with a lower edge of the collision plate.

5. An oil separator as claimed in claim 3, wherein each of the passage holes is shaped as an equilateral triangle in cross-section, the cross-sectional equilateral triangle having a base parallel with a lower edge of the collision plate.

6. An oil separator as claimed in claim 3, wherein each of the passage holes has a length of not less than two times an equivalent diameter of the passage hole.

7. An oil separator as claimed in claim 3, wherein the partition wall is plate-shaped.

* * * * *